US005570114A

United States Patent [19]

Fowler

[11] Patent Number: 5,570,114

[45] Date of Patent: Oct. 29, 1996

[54] CONTROL PANEL ILLUMINATION

[75] Inventor: James H. Fowler, Novi, Mich.

[73] Assignee: Ford Motor Company, Dearborn, Mich.

[21] Appl. No.: 397,314

[22] Filed: Mar. 2, 1995

Related U.S. Application Data

[63] Continuation of Ser. No. 122,969, Sep. 17, 1993, abandoned.

[51] Int. Cl.[6] ..... G09G 3/02

[52] U.S. Cl. ..... 345/173; 200/5 A; 345/45; 116/DIG. 35

[58] Field of Search ..... 345/33, 45, 172, 345/173, 175; 200/5 A, 292, 310, 313, 317; 340/815.4, 815.48, 815.55; 116/DIG. 35, 279, 202

[56] References Cited

U.S. PATENT DOCUMENTS

| | | | |
|---|---|---|---|
| 4,060,703 | 11/1977 | Everett, Jr. | 200/5 A |
| 4,320,268 | 3/1982 | Brown | 200/5 A |
| 4,449,024 | 5/1984 | Stracener | 200/317 |
| 4,532,395 | 6/1985 | Zukowski | 200/314 |
| 4,641,963 | 2/1987 | Levine | 356/124.5 |
| 4,642,627 | 2/1987 | Hodsdon | 345/50 |
| 4,667,273 | 5/1987 | Queudray | 362/34 |
| 4,730,146 | 3/1988 | Maser et al. | 313/511 |
| 4,740,781 | 4/1988 | Brown | 345/174 |
| 4,764,719 | 8/1988 | Zeh | 324/459 |
| 4,812,831 | 3/1989 | Laier | 345/175 |
| 4,916,262 | 4/1990 | Jungels-Butler et al. | 200/5 A |
| 4,920,243 | 4/1990 | Yuge | 200/310 |
| 5,049,865 | 9/1991 | Nakamura et al. | 345/60 |
| 5,059,960 | 10/1991 | Rosenberg et al. | 345/174 |
| 5,087,858 | 2/1992 | Cherry et al. | 315/169.3 |
| 5,093,654 | 3/1992 | Swift et al. | 345/76 |
| 5,097,396 | 3/1992 | Myers | 362/32 |
| 5,138,119 | 8/1992 | Demeo | 200/5 A |
| 5,149,923 | 9/1992 | Demeo | 200/5 A |

FOREIGN PATENT DOCUMENTS

| | | |
|---|---|---|
| 0175186 | 8/1985 | European Pat. Off. . |
| 2266282 | 1/1975 | France . |
| 3517551 | 11/1985 | Germany . |
| 8429030 | 6/1987 | Germany . |

OTHER PUBLICATIONS

"Touchlight Control/Display Panel", E. R. Wiener, IBM Technical Disclosure Bulletin, vol. 14, No. 7, Dec. 1971, pp. 1963–1965.

*Primary Examiner*—Curtis Kuntz
*Assistant Examiner*—Minson Oh
*Attorney, Agent, or Firm*—Mark L. Mollon; Roger L. May

[57] ABSTRACT

A control panel includes controllers in the form of push buttons supported by an elastomeric switch pad over an electroluminescent lamp panel. The electroluminescent panel includes circuits formed by chargeable areas which register with optical indicia carried by the buttons and transmitted through openings in the elastomeric layer. The elastomeric layer includes pads which resiliently urge the buttons to a rest position at which contacts carried by the elastomeric pad are spaced apart from terminal conductors on a printed wiring board. A peripheral wall of the pad formed with the elastomeric layer is supported by a tactile membrane which permits depression of the button to engage the contact against the terminal conductors of the printed wiring board, and returning the button to the rest position. The control panel controls that operate in response to audio system operating modes, for example, the controls related to a cassette player, can be identified by different color or intensity of light depending on the drive circuits applied to the chargeable areas formed on the electroluminescent lamp panel.

20 Claims, 2 Drawing Sheets

CONTROL PANEL ILLUMINATION

This is a continuation of application Ser. No. 08/122,969 filed on Sep. 17, 1993, now abandoned.

FIELD OF THE INVENTION

The present invention relates generally to illumination of indicia on a control panel and, more particularly, to audio system bezels for motor vehicles having illuminated optical indicia on controls of the audio system.

BACKGROUND ART

Control panels often have background illumination in order to expose graphics or optical indicia that identify the functions related to particular controls on the control panel. The traditional choice for illuminating control panel graphics located above, on or below a button or switch actuator, particularly in motor vehicle audio entertainment systems, has been an arrangement of incandescent lamps and light pipes, for example, as shown in U.S. Pat. No. 4,449,024. A light pipe may be formed as a transparent or translucent panel but must be specially constructed with reflecting baffle surfaces and the like to direct light rays in particular directions at various distances and locations from an incandescent light source. Thus the substantial engineering, design and implementation of the light pipe requires a long lead time, particularly with a complex light path arrangement for audio system control bezels. Accordingly, such structures were correspondingly expensive. However, they do not offer a balance of light color and intensity throughout the light pipe and they provide little or no differentiation of button actuator function graphics. For example, the illumination is unable to distinguish the operable controls of an audio system bezel or control panel during operation of a radio receiver from the operable controls and other functions during operation of a cassette tape player or a compact disc player once a different operating mode has been selected on the control panel. Furthermore, the light reflective surfaces arranged to reflect light toward a push button face after traveling transversely behind the buttons through the light pipe introduce illumination losses that interfere with identification of indicia, distinction between the indicia, and a user's selection of desired control.

Other known lighting structures include background illumination for translucent or clear button grids where a light source provides background lighting for indicia in the button. For example, U.S. Pat. Nos. 5,138,119 and 5,149,923 to Demeo disclose tactile dome switches with an illumination diode positioned beneath each dome. In other instances, the illumination is provided by an electroluminescent panel providing back lighting for the indicia. For example, U.S. Pat. Nos. 4,060,703, 4,320,268 and 4,532,395 disclose keyboard panels in which an electroluminescent panel provides background illumination for the push button indicia. Nevertheless, a luminescent panel does not distinguish one set of push buttons from another, even where the push button may be provided with multiple functions in different operating modes of the apparatus.

Moreover, in view of the complicated structures and the numerous layers of transparent or translucent material through which the light must be transmitted and controlled, previous switch constructions have suffered from mechanical disadvantages. For example, the tactile response or feel of the switches may not be as positive as is desirable for human interaction with the switches. Moreover, tactile response may be unrelated to switch closing contact, for example, when contact is made between the button contacts and a printed wiring board terminal or internal switch terminal. As a result, even though electroluminescent lamp panels have been used for back lighting keyboards, previously known switches using such panels have been difficult to build with the positive feel that is desired to complement complete switch actuation. For example, such feel is readily available in an opaque rocker switch with a domed resilient support or a push button with a dome support that provides a desirable tactile response. Accordingly, many engineering tradeoffs required a compromise between illumination clarity and switch reliability or operability.

SUMMARY OF THE PRESENT INVENTION

The present invention overcomes the above-mentioned disadvantages by providing a control panel with a face panel having buttons, and at least one of the face panel and the buttons having optical indicia that is illuminated by an electroluminescent lamp panel below an opening in an elastomeric switch pad. The elastomeric switch pad includes a wall around the opening, which registers with optical indicia on the panel or on a control such as a button on the panel, serving to channel light from the electroluminescent panel to the optical indicia.

In the preferred embodiment, the elastomeric switch pad includes pads used to support buttons on the control panel, the pads resiliently biasing the button to a released position at which contacts carried by the elastomeric wall remains spaced apart from a complementary switch closure. The buttons are then pressed against the resilient biasing force of the elastomeric switch pad to displace contact members through openings in the electroluminescent lamp panel into engagement with the complementary switch closure, for example, terminal conductors on a wiring board. Preferably, the electroluminescent lamp panel includes a plurality of chargeable areas, each area coupled to an independent drive circuit operated in response to a particular system function so that selected optical indicia or areas of optical indicia may be illuminated in accordance with a predetermined arrangement of functions controlled by the control panel.

In the preferred embodiment, a motor vehicle audio system console includes a bezel having a plurality of push button switches supported in bezel openings by an elastomeric layer behind the bezel panel. The elastomeric layer carries the switch contacts registering with openings in the adjacent electroluminescent lamp layer for communication with terminal conductors of an adjacent printed wiring board carried behind the electroluminescent lamp panel. Preferably, the electroluminescent lamp panel includes a plurality of chargeable areas, each chargeable area being selectively connected to a charging circuit in response to selection of a particular audio system function. Accordingly, only the optical indicia and graphics on the panel and on the controls related to a particular function are illuminated by a chargeable area. In addition, each charging circuit can be separately powered by different frequency AC voltages to provide corresponding color differences in the illumination of the affected optical indicia.

As a result, the present invention provides a substantially better interface between the control panel user and the control panel as it simplifies and clarifies the functions of related controls on the control panel. In addition, the present invention provides a user compatible control panel whose controls operate with ease but avoid unnecessarily loose fit between the buttons and the openings in the control panel. Moreover, the present invention avoids illumination obscurity which occurs when the light source is covered by translucent or numerous layers of transparent material.

Moreover, the present invention provides an audio system bezel structure which is easily manipulated by a user to perform a wide variety of entertainment functions without the complications of previously known multiple function controls and multiple function control panels. In particular, the bezel control panel is easier to operate than previously known panels where a control is provided for a single function only or where a single control provides for adjustment of several functions depending upon the mode of operation of the audio system. Furthermore, different and functionally unique control panel assemblies may be built with the same production equipment with only minor flexible tooling changes that substantially reduce tooling complexity and cost. Moreover, it avoids the extended lead time for engineering and development required for light pipe structures. Moreover, the panel construction is substantially less expensive to produce and to assemble than previously known illuminated panels and illuminated buttons, particularly when compared with previously known light transmission techniques such as light pipes.

BRIEF DESCRIPTION OF THE DRAWING

The present invention will be more clearly understood by reference to the following detailed description of a preferred embodiment when read in conjunction with the accompanying drawing in which like reference characters refer to like parts throughout the views and in which.

DETAILED DESCRIPTION OF A PREFERRED EMBODIMENT

Figure 1:
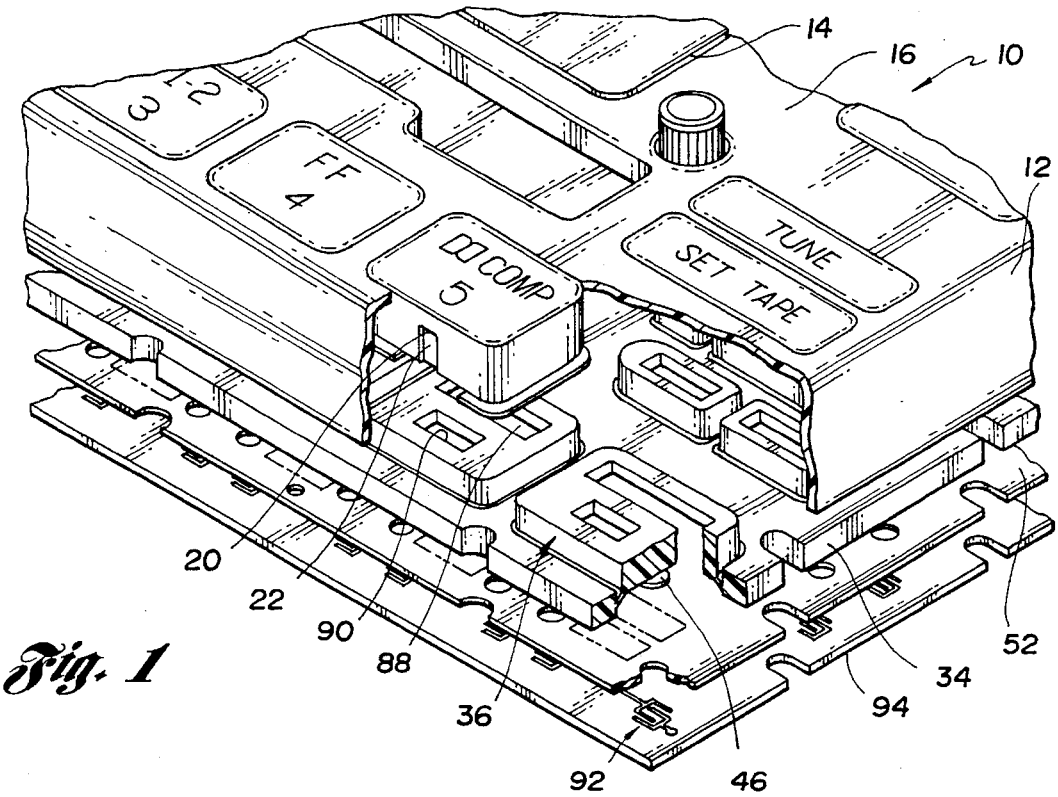
FIG. 1 is a fragmentary, perspective and exploded view of a audio system bezel constructed according to the present invention.

Referring first to FIG. 1, a control panel 10, for example, of the type used for audio systems in motor vehicles, such as an AM/FM radio with a cassette player or a compact disc player, is thereshown comprising a bezel housing 12 adapted to mount on an audio system control assembly 69 in a position facing a user such as the vehicle's passengers. As is typical with such systems, the bezel housing 12 includes a display area for a display device 14 for providing a visual indication of the mode of operation of the audio system, the radio wave frequency to which the receiver is tuned, a symbol indicating when a stereophonic signal is being received by the receiver, a symbol indicating the direction of tape play as well as other pertinent information and the related symbols. In addition, the bezel is provided with additional graphic indicia or optical indicia on its face surface 16 as well as optical indicia on push buttons 20 carried by the bezel housing 12. As used in this description, the term buttons may be understood to refer to all controls that are manipulated from the face of the bezel. However, depressible actuators such as rocker switches or push buttons are particularly advantageous for use with the present invention as will be discussed with respect to the push buttons described. Such push buttons provide a positive tactile response to the user while visibility of the indicia is improved without detracting from the ease of operating the audio system functions from the control panel 10.

The bezel face 16 includes a plurality of openings 18 adapted to receive the correspondingly shaped buttons 20. In addition, the audio system may also include buttons of various sizes and shapes and the openings may be partitioned to receive a plurality of buttons within a single area shaped to match the shape of other buttons on the panel. Furthermore, the button shapes may vary to aid in identification of different sets of buttons. Nevertheless, the illuminating system for the bezel of the present invention serves to improve identification of the controls applicable to each various system function by separately illuminating the applicable controls for an audio system function as will be described in greater detail hereinafter.

Figure 2:
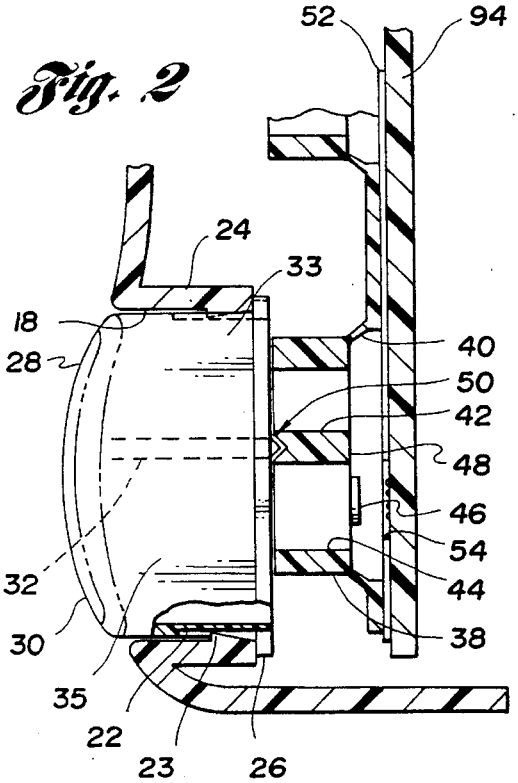
FIG. 2 is an enlarged sectional view taken substantially along the lines 2—2 in FIG. 1.

The buttons 20 are retained in the openings 18 by an appropriate interlock, for example, the grooves 22 on opposing sides of the button 20 each receive a ramp protrusion 23 (FIG. 2) on the perimeter wall 24. As best shown in FIG. 2, an enlarged base flange 26 prevents extraction of the button 20 from an opening 18 by abutment with the perimeter wall 24. In the preferred embodiment, the buttons 20 are made in two parts, the top or face surface being made of a translucent plastic material bonded to the remaining portion of the button body, preferably made of an opaque material. The button may be painted to match the color of the bezel 12. One or more optical indicia are formed on the painted button by laser etching a graphic or alpha-numerical symbol in the paint coating so as to expose the translucent material on the top surface within the etched graphic symbol. In the event that more than one optical indicia is carried by a single button, for example, at 28 and 30 in FIG. 2, the button may include a partition wall 32, preferably black as formed by the two-shot injection molding process discussed above, that separates the areas including the optical indicia 28 and the optical indicia 30.

The base of the button 30 rests upon an elastomeric switch pad 34. The switch pad 34 is made of thermoset silicon elastomeric rubber compound, standard ASTM D-2000, for example, M3 G.E. 506A19B37G11. The switch pad 34 is compression molded to include a plurality of raised pads 36 positioned to register with each of the buttons 20. The pad 36 is formed by a wall 38 engaging the base of the button 20 to resiliently urge the flange 26 against the perimeter wall 24 of the bezel housing 12. Resilient biasing of the wall 38 may be provided by a tactile membrane portion 40 connecting the wall 38 with the main body portion of the layer 34. The tactile membrane 40 not only resiliently maintains the pad 36 in a position shown in FIG. 2, but the button 20 may be easily depressed by a user against the resilient force of the tactile membrane 40. The tactile membrane is formed according to known compression molding techniques dependent upon the peak force to be exerted by the membrane, the total displacement of the pad, and the amount of tactile detent or snap ratio for membrane collapse. In any event, the tactile membrane may be built according to a wide range of snap ratios, preferably with a perceptible click.

The top of the pad 36 includes an opening in registration with the optical indicia 28 and 30 carried by the button 20. The upper wall of the pad 36 carries a contact member 46 on its bottom surface 48. The top surface of the pad 36 may be configured to mate with or lie adjacent to the partition 32 of the button 20. Moreover, the partition 32 and the wall of pad 36 may be correspondingly configured, as in the tongue and groove arrangement shown at 50, although it is to be understood that the resiliently extended wall 38 may be relied upon to block light transmission between the openings 42 and 44 into the areas 33 and 35 divided by the partition 32. Preferably, the switch pad 34 is white so that the partition walls reflect rather than absorb the light transmitted through an opening in the elastomeric pad 34.

Figure 4:
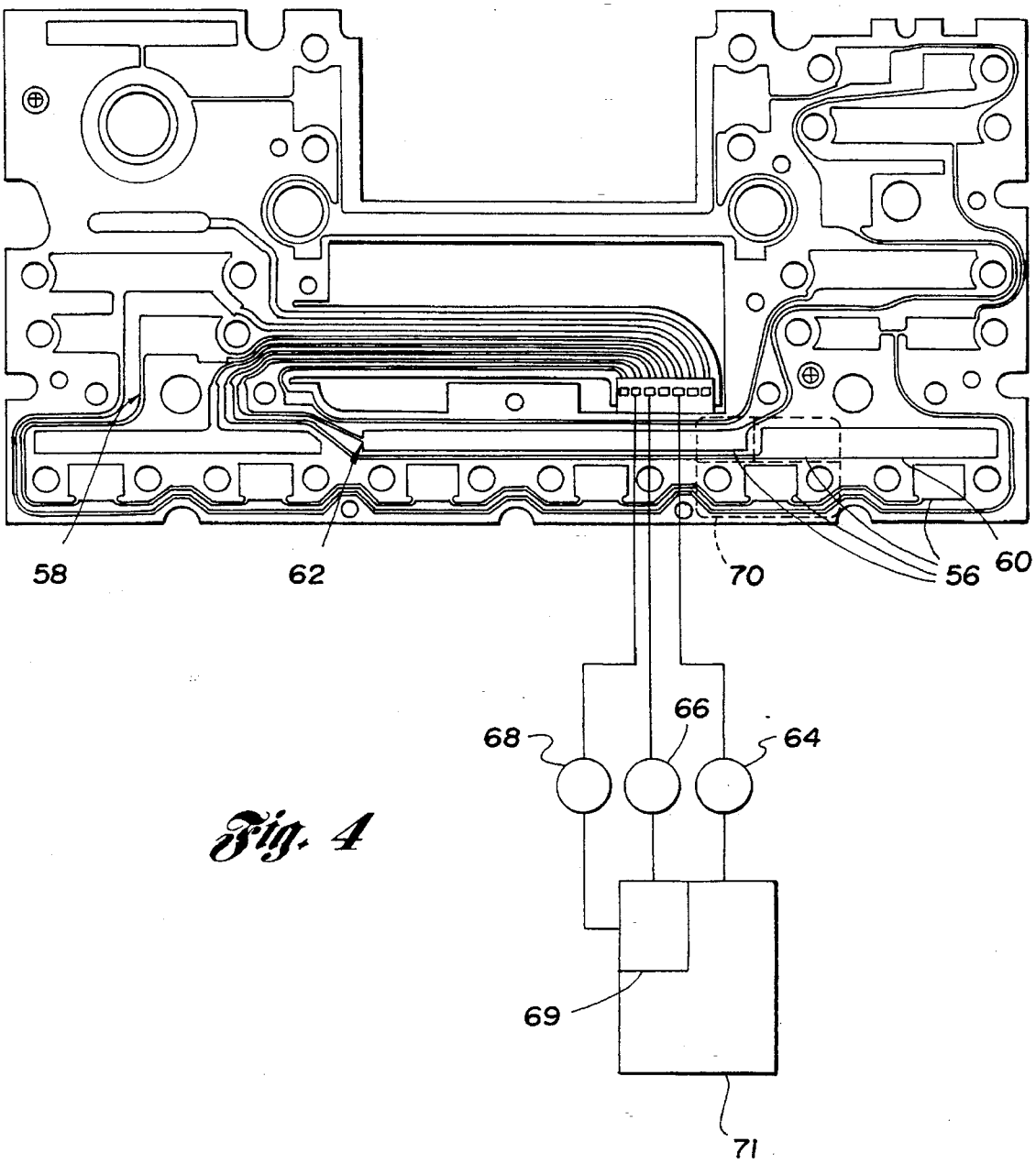
FIG. 4 is a plan view of electroluminescent lamp panel having chargeable areas configured according to the present invention.

An electroluminescent lamp panel (EL panel) 52 lies adjacent the elastomeric layer 34. The EL panel is preferably made of a microencapsulated phosphor intermediate conductive plates as may be made available in a well known manner, for example, Durel 3 Trimlite for AC current activation. In such a panel, glass beads containing phosphor lie between the two conductive layers. In the present invention, a plurality of circuits may be formed in the EL panel by oblation of portions of a conducting layer, for example, by laser burning an indium tin oxide layer. Likewise, peripheral areas around openings such as the opening 54 shown in FIG. 2 will also be oblated. As best shown in FIG. 4, a plurality of chargeable areas 56 are formed on the EL panel and interconnected by conductive trails formed during the oblation process.

Selected chargeable areas 56 may be separated and electrically insulated from other connected chargeable areas 56 to form separate circuits such as 58, 60 and 62 as shown in FIG. 4. Each of the circuits 58, 60 and 62 would be connected to a drive circuit 64, 66 and 68, respectively, driven in accordance with the audio system control assembly 69 of audio system 71. For example, the drive circuits 64, 66 and 68 may be provided as different operating states of a switching power supply. Moreover, the expanded chargeable areas 56 may be provided in areas that do not register with optical indicia on the bezel or the buttons for the purpose of balancing the load of each circuit 58, 60 and 62 on the power supply. In any event, the circuits may be operated alternatively or simultaneously as required by the selectively functioning audio system 71.

Figure 3:
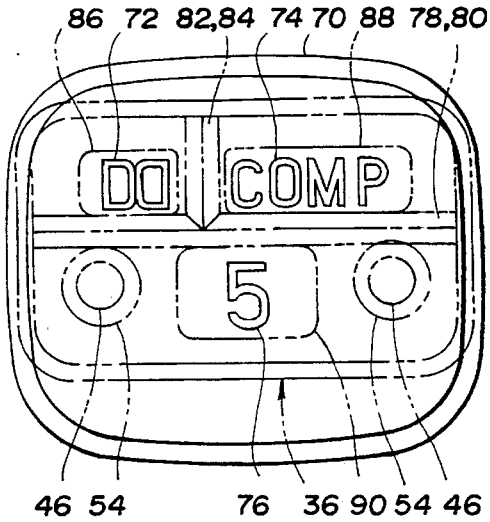
FIG. 3 is an enlarged plan view of a button employed in a face panel of the type shown in FIG. 1.

Referring now to FIG. 3, a button body 70 formed substantially in the manner of the button 20 includes multiple, preferably opaque, partitions and optical indicia for demonstrating the interplay of the circuits 58, 60 and 62 referred to in FIG. 4. In particular, the face of the button 70 includes an optical indicia 72 on the left top side, an optical indicia 74 on the top right side, and optical indicia 76 below the indicia 72 and 74. As a result, the button 70 includes a preferably opaque partition wall 78 separating the upper optical indicia 72 and 74 from the lower optical indicia 76. In addition, a corresponding wall portion 80 of the elastomeric perimeter wall 38 of a pad 36 overlies the partition 78. Similarly, a partition 82 formed in the button 70 overlies a wall portion 84 of the pad 36. In addition, the elastomeric pad 34 has openings for example, the openings 86, 88 and 90 registering with and outlining the optical indicia 72, 74 and 76 respectively. The pad 36 carries two contact members 46 for redundant excitation of a switch closure for actuating an appropriate circuit board function on a printed wiring board 92 as discussed below.

As shown in FIG. 3, the openings 86, 88 and 90 in the elastomeric layer and the registering optical indicia 72, 74 and 76 on the button 70 are also in registration with chargeable areas in the circuits 62, 60 and 58 respectively shown in FIG. 4. Thus for example, when the audio system control assembly 69 has been switched to operate a cassette tape player of the system 71, the illumination channel or circuit 62 will be charged to illuminate the indicia, for example, the noise reduction toggle switch indicated by the symbol 72 in response to the drive circuit 64. Then a depression of the button 70 engages either or both contacts 46 through the openings 54 into engagement with the terminal conductors 92 on the printed wiring board 94 to alternately turn on or off the noise reduction function. Moreover, the other chargeable areas in circuit 62 will be illuminated to identify other buttons on bezel face 16, for example, rewind, fast forward and eject function selection buttons that will be likewise illuminated for that function.

In a similar manner, the indicia 74 will be illuminated through the opening 88 by means of a chargeable area in the circuit 60 in response to the drive circuit 66 when the CD player function has been selected. When that selection has been made, actuation of the button body 70 will determine whether the dynamic range is compressed or not compressed. Again, one or more contacts 46 for a switch closure across the terminal conductors 92 on the printed wiring board 94. This switch closure will send appropriate control signals to the audio system control assembly 69 in a well known manner. Alternatively, when the radio mode has been selected, for either the FM or AM band, the circuit 64 energizes the chargeable areas of the illumination channel or circuit 58, including the portion behind button body 70 as shown in the footprint 70 in FIG. 4, designating the number of a preset station. The preset station frequency can be tuned in and reselected by depression of the button 70 when the audio system is operating in the AM or FM reception mode, while the other functional mode graphics on that button are then not illuminated.

The bezel structure of the preferred embodiment is completed with a printed wiring board 94 including appropriately wired circuits for activation of different functions of the audio system control assembly 69 in a well known manner. In conjunction with the contact 46 supported for displacement by the buttons 20, the circuit board 94 includes terminal conductors 92 made up of interdigitized bands of opposite polarity coupled to appropriate circuitry, for example, mounted on the printed wiring board 94 or coupled to conductor traces leading to terminals that may be coupled to appropriate circuits in the audio system control assembly 69. In any event, the terminal conductors 92 are structured so that engagement of the contacts 46 closes a circuit between the opposite polarity bands in a well known manner, although other forms of switch closures could also be used. Preferably, the terminal conductors 92 and the contacts 42 are arranged in parallel pairs so that engagement of either or both contacts 46 by depression of the button 20 closes the electrical path between the opposite polarity bands of the terminal conductors 92.

As a result, the present invention provides an electroluminescent lamp layer in a audio system bezel and having multiple channels which can be powered as desired in response to selected audio system control assembly functions as they are selected. Accordingly, a series of optical indicia may be illuminated by a circuit when a particular audio system function has been selected. Moreover, in accordance with more recent developments in audio system structures, digital signal processing (DSP) audio systems in which the function of a button on the audio system bezel is determined in response to selection of a particular audio system function, one or more optical indicia may be carried on a single controller and alternately illuminated.

Moreover, in view of the fact that AC electroluminescent lamps will produce differently colored light depending upon the frequency of the signal used to energize the chargeable areas, each audio system function may be identified by a different arrangement of colored zones. The color matched optical indicia would identify the buttons and the related functions that adjust parameters or characteristics of the selected audio system function mode and they are readily identified for adjustment by a user. Moreover, the present invention provides greater illumination and light intensity for each of the optical indicia than previously known EL panel background illumination structures.

In addition, the present invention provides a simple and effective user interface with the audio system as the buttons provide an improved tactile response which is ordinarily associated only with specially designed and constructed switching apparatus. Moreover, the flexibility of changing the bezel layers to incorporate both DSP or analog audio system in a common production package is easily accomplished, for example, molds used to injection mold the bezel housing 12 can be easily changed with inserts to incorporate different control or push button structures. For example, the openings on the bezel may include partitions to receive separate buttons for operation of a plurality of components even though the bezel used in a related product line audio system provides a single opening for a single push button. However, each button is supported by a pad 36 correspondingly positioned and configured for the button and registering with a chargeable area on an electroluminescent lamp panel.

Having thus described the present invention, many modifications thereto will become apparent to those skilled in the art to which it pertains without departing from the scope and spirit of the present invention as defined in the appended claims.

I claim:

1. An illuminated control panel comprising:

a bezel panel having a plurality of openings;

at least one button received in one of said openings;

at least one of said bezel panel and said at least one button having at least one optical indicia;

an elastomeric layer beneath said button and said panel, wherein said layer has an opening communicating with said optical indicia and a wall portion resiliently maintaining said at least one button in said one opening, and at least one contact element registering with said button and carried on the surface opposite the button;

an electroluminescent lamp panel beneath said elastomeric layer including at least one chargeable area in communication with said elastomeric layer opening, and an opening in said electroluminescent lamp panel in registration with said contact element; and a printed wiring board having electrical terminals registering with said electroluminescent lamp panel opening and said contact element for closing an electrical circuit by depressing of said button against the force of said elastomeric layer wall.

2. The invention as defined in claim 1 wherein said at least one optical indicia comprises first and second optical indicia and wherein at least one of said elastomeric layer and said button include a partition intermediate said first optical indicia and said second optical indicia.

3. The invention as defined in claim 2 wherein said electroluminescent lamp panel includes at least one first and at least one second chargeable areas, each said chargeable area being in registration with one of said first and second optical indicia.

4. The invention as defined in claim 3 wherein each said at least one first chargeable area is electrically insulated from each said at least one second other.

5. The invention as defined in claim 4 and further comprising a first charging circuit electrically coupled to said first chargeable area and a second charging circuit coupled to said second chargeable area.

6. The invention as defined in claim 3 wherein said at least one first and said at least one second chargeable areas are electrically coupled to a common charging circuit.

7. The invention as defined in claim 5 wherein said control panel comprises an audio system bezel and each charging circuit is responsive to a selected audio system function.

8. The invention as defined in claim 2 wherein one of said at least one button includes said first and second optical indicia.

9. The invention as defined in claim 8 wherein said one button includes a plurality of first and second optical indicia.

10. An illumination system for a control panel having a plurality of optical indicia and a plurality of controls comprising:

an electroluminescent lamp panel including at least one chargeable area configured to register with at least a portion of said plurality of optical indicia;

at least one charging circuit for applying voltage across each said chargeable area;

wherein one of said plurality of controls comprises a switch for selectively coupling one of said at least one charging circuit to said chargeable area; and wherein said at least one chargeable area comprises a plurality of first chargeable areas, and a plurality of second chargeable areas, each of said plurality of first and second chargeable areas registering with an optical indicia, wherein said at least one charging circuit comprises at least one first charging circuit coupled to said first plurality of chargeable areas and at least one second charging circuit coupled to said plurality of second chargeable areas; and wherein at least one control of said plurality of controls includes a plurality of indicia and a chargeable area from each said plurality of first and second chargeable areas is located in registration with indicia for said at least one control.

11. The invention as defined in claim 10 wherein multiple optical indicia are included on a plurality of said controls.

12. The invention as defined in claim 11 wherein said plurality of controls comprise push buttons.

13. The invention as defined in claim 10 wherein said plurality of controls comprises at least one push button, a resilient member intermediate said button and said electroluminescent lamp panel and carrying a contact, and wherein said electroluminescent lamp layer includes an opening in registration with said contact.

14. The invention as defined in claim 13 wherein said control panel includes a printed wiring board including a dipole terminal exposed in registration with said contact and said opening.

15. The invention as defined in claim 14 wherein said resilient member comprises an elastomeric switch pad resiliently urging said button away from said dipole terminal.

16. A control panel for a motor vehicle audio entertainment system a plurality of entertainment sources taken from the group consisting of AM radio receiver, FM radio receiver, audio tape player an compact disc player; the control panel comprising:

a plurality of optical indicia on said control panel including a predetermined set of indicia associated with one of the plurality of entertainment sources, an electroluminescent lamp panel including a plurality of chargeable areas, and the plurality of chargeable areas corresponding in number to at least as many as the number of the plurality of entertainment sources; at least one chargeable area configured to correspond with said predetermined set of indicia;

a plurality of charging circuits for applying voltage to said plurality of chargeable areas in the electroluminescent lamp panel; and a selector for coupling at least one of said plurality of charging circuit to said at least one chargeable area configured to correspond with said predetermined set in response to actuation of said one of said plurality of entertainment sources.

17. The invention as defined in claim 16 wherein each chargeable area is aligned in registration with a plurality of optical indicia related to the selected source.

18. The invention as defined in claim 17 wherein said control panel includes at least one control and wherein at least one said optical indicia is carried by said at least one control.

19. A control panel with controllers for a motor vehicle audio entertainment system including:

a plurality of entertainment sources taken from the group consisting of AM radio receiver, FM radio receiver, audio tape player and compact disc player;

an electroluminescent lamp panel including a first plurality of chargeable areas;

a second plurality of charging circuits for applying voltage to said chargeable areas;

a selector for coupling a first charging circuit to a first predetermined set of at least one said chargeable area in response to actuation of one of said sources; and a selector for coupling a second charging circuit to a second predetermined set of at least one said chargeable area in response to actuation of another of said sources, and wherein a portion of said first predetermined set and a portion of said second predetermined set register with first and second indicia, respectively, on a single controller.

20. An illuminated control panel comprising:

a bezel panel having a plurality of openings;

at least one of said bezel panel and said at least one button having a first optical indica and a second optical indicia adjacent said first optical indicia;

an elastomeric layer beneath said button and said panel, wherein said layer has an opening communicating with each said optical indicia and a wall portion resiliently urged against said button intermediate said first and said second optical indicia;

an electroluminescent lamp panel beneath said elastomeric layer including a first chargeable area in communication with a first elastomeric layer opening on one side of said wall portion, and a second chargeable area in communication with a second elastomeric layer opening on another side of said wall portion; and said electroluminescent lamp panel includes at least one first and at least one second chargeable areas, each said chargeable area being in registration with one of said first and second optical indicia.

* * * * *